United States Patent [19]

Brim

[11] Patent Number: 4,834,378

[45] Date of Patent: May 30, 1989

[54] METHOD OF PLAYING OF BOWLING GAME

[75] Inventor: Ted E. Brim, Grand Haven, Mich.

[73] Assignee: Brunswick Corporation, Skokie, Ill.

[21] Appl. No.: 118,245

[22] Filed: Nov. 9, 1987

[51] Int. Cl.[4] ..... A63D 3/00

[52] U.S. Cl. ..... 273/37

[58] Field of Search ..... 273/37, 54 R, 54 C, 273/54 D

[56] References Cited

U.S. PATENT DOCUMENTS

| | | | |
|---|---|---|---|
| 3,153,538 | 10/1964 | Rogers | 273/43 D |
| 3,212,780 | 10/1965 | Jewell | 273/54 C |
| 3,529,824 | 9/1970 | Walch | 273/54 R |
| 4,597,575 | 7/1986 | Kosof | 273/37 |

FOREIGN PATENT DOCUMENTS

| | | | |
|---|---|---|---|
| 809541 | 4/1969 | Canada | 273/54 C |

OTHER PUBLICATIONS

First Stage Market Test of Brunswick's New Bowling System–Final Report, Apr. 1986.

*Primary Examiner*—Anton O. Oechsle

*Attorney, Agent, or Firm*—Wood, Dalton, Phillips, Mason & Rowe

[57] ABSTRACT

A method of playing a bowling game in which players are allowed a preselected number of balls to knock down all pins in each of a plurality of frames. A sequence of a plurality of differing pin setups of a constant number of pins is selected for each frame, up to a maximum of nine pins. Each player is required to deliver at least one ball in each of the frames. The number of pins knocked down by each player in each frame is counted, with strikes recorded for all pins knocked down by a first ball and spares recorded for all pins knocked down by a second ball. The number of pins knocked down by the respective player on the next two balls is added if a strike was recorded in the previous frame. The number of pins knocked down by the respective player on the next one ball is added if a spare was recorded in the previous frame. This determines the score for each player for each frame, which is recorded. Each player's frame scores are added to determine the player's total score for the game, and a comparison of the player's game scores determines the winner of the game.

11 Claims, 1 Drawing Sheet

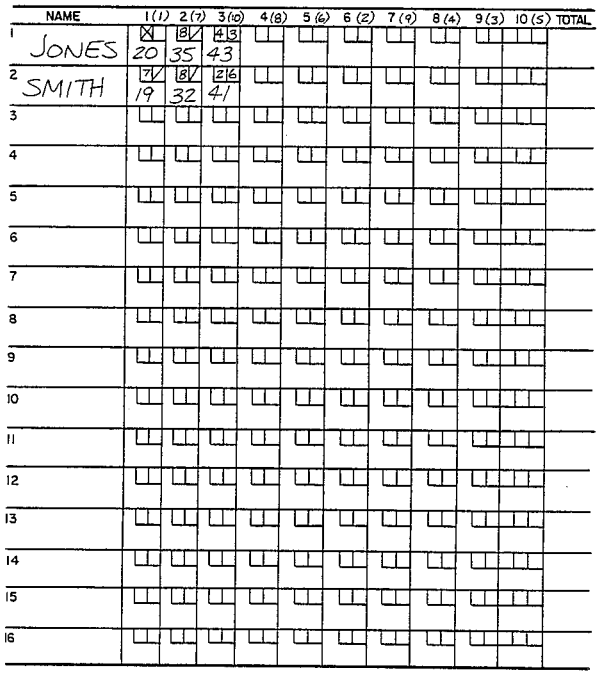

| NAME | 1 (1) | 2 (7) | 3 (10) | 4 (8) | 5 (6) | 6 (2) | 7 (9) | 8 (4) | 9 (3) | 10 (5) | TOTAL |
|---|---|---|---|---|---|---|---|---|---|---|---|
| 1 JONES | X 20 | 8/ 35 | 43 43 | | | | | | | | |
| 2 SMITH | 7/ 19 | 8/ 32 | 26 41 | | | | | | | | |
| 3 | | | | | | | | | | | |
| 4 | | | | | | | | | | | |
| 5 | | | | | | | | | | | |
| 6 | | | | | | | | | | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

METHOD OF PLAYING OF BOWLING GAME

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by the players in turn. There is a definite need for new methods of playing a bowling game which are more exciting during the entire play of the game; for games which are challenging but not difficult; and for games to increase and enhance the public interest in the sport. This invention is directed to satisfying these needs and to rectifying lack of interest problems in the conventional method of playing a bowling game. The method of playing a bowling game according to the present invention incorporates conventional scoring methods but poses the players with differing pin setups at the beginning of each frame.

SUMMARY OF THE INVENTION

An object of the invention, therefore, is to provide a new method of playing a bowling game in which players are allowed a preselected number of balls to knock down all pins in each of a plurality of frames.

According to the inventive method, a sequence of a plurality of differing pin setups is selected, the differing pin setups having a constant number of pins, less than ten, for each frame. In other words, less than a conventional ten-pin setup scheme is used. The scheme may incorporate seven-pin setups, or eight-pin setups, or nine or whatever. In each turn, a player is given credit for the "missing" pin(s). Each player is required to deliver at least one ball in each of the frames. The number of pins knocked down by each player in each frame is counted (with credit for "missing" pins), with strikes recorded for all pins knocked down by a first ball and spares recorded for all pins knocked down by a second ball. A "credit" is given to each player for the missing pin or pins on his first ball in each frame. Added to the counted number of pins are the number of pins knocked down by the respective player on the next two balls if a strike was recorded on the previous frame, and the number of pins knocked down by the respective player on the next one ball if a spare was recorded in the previous frame, to determine a score for each player for each frame. Each player's frame score then is recorded, and each player's frame scores are added to determine the player's total score for the game. The players' game scores are compared to determine the winner of the game.

It can be seen that, whereas a conventional bowling game uses a plurality of pin setups of identical ten-pin triangular arrays, the method of playing the bowling game of this invention contemplates a sequence of a plurality of differing pin setups of a constant number of pins but of different pins missing from the conventional ten-pin array. For instance, each of the differing pin setups may include nine pins. Therefore, in a ten-frame game, each one of the ten pins can be eliminated or "missing" in each frame. For instance, a sequence of a plurality of differing pin setups might include ten-pin setups with each frame missing a particular pin, such as pins 1, 7, 10, 8, 6, 2, 9, 4, 3 and 5 for the respective pin frames. Similar schemes can be derived for eight-pin setups, or seven-pin setups, and so on.

The sequence of differing pin setups may be predetermined, such as the above order. On the other hand, a more interesting game can be to randomly select the plurality of differing pin setups (i.e. randomly selecting the missing pins). In addition, a given player could select the missing pin, with all of the other players having to play the same pin setup or setups. Still further, each player can be allowed to select the missing pin for one or more of his pin setups or frames.

Other objects and features of the invention will be apparent from the following detailed description taken in connection with the accompanying drawing.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawing showing a simulated score sheet which might be used in playing the bowling game of this invention.

DETAILED DESCRIPTION OF THE PREFERRED EMBODIMENT

According to the invention, a method of playing a bowling game generally comprises players being allowed a preselected number of balls to knock down all pins in each of a plurality of frames. As in a conventional bowling game, each player can be allowed two balls to knock down all pins in each of a plurality of ten-pin setup frames. With the invention, a sequence of a plurality of differing pin setups of a constant number of pins is employed for each frame. For purposes of illustration, the game is set up for a plurality of differing nine-pin setups. In other words, in a ten-frame game, one of the conventionally numbered pins "1" to "10" is missing from each frame. The sequence of differing pin setups may be predetermined, randomly selected or player selected.

For instance, a predetermined sequence of a plurality of ten differing pin setups (i.e. representing ten consecutive frames) might have the following sequence of missing pins from the respective frame: 1, 7, 10, 8, 6, 2, 9, 4, 3 and 5. Of course, other predetermined sequences of missing pins are contemplated. On the other hand, the sequence of differing pin setups or frames can be randomly selected either manually, such as using index cards or the like, or through a random computer system. Still further, players themselves may select the sequence of differing pin setups. One player may be allowed to select the pin setups, with the remaining players having to play against the chosen sequence. On the other hand, each player may choose a frame or a sequence of frames, respectively designating the missing pin or pins. The missing pin for a given player can be the same for all frames or different for each frame. It can be seen that a wide variety of schemes can be used with the general method of playing a bowling game according to the invention, wherein players are required to deliver a preselected number of balls to knock down all pins in each of a plurality of frames having pin setups with a lesser number of pins than the ten-pin frames of a conventional bowling game.

Once the selection process of the differing pin setups is performed, each player is required to deliver at least one ball, preferably a maximum of two balls, in each of the differing pin setup frames. The number of pins knocked down by each player in each frame is counted, and the player is given credit for the "missing" pin (or pins) on his first ball in each frame with strikes recorded for all pins knocked down by a first ball and spares recorded for all pins knocked down by the allotted number of balls, such as two.

As with a conventional bowling game, the number of pins knocked down by a respective player on the next two balls is added to a given frame if a strike was recorded in the previous frame. The number of pins knocked down by a respective player on the next one ball is added if a spare was recorded in the previous frame. This determines a score for each player for each frame.

At the end of the game, each player's frame scores are added to determine that player's total score for the game. The players' game scores are compared to determine the winner of the game.

Turning to the FIGURE of the drawing, a conventional score sheet for bowling games is illustrated and can be used with the method of playing the bowling game according to the invention. It can be seen that ten frames are enumerated across the top of the score sheet to designate scoring columns for a number of players whose names are inserted in the left-hand column, as is shown.

Without repeating, a particular sequence of a plurality of differing pin setups of nine pins then is determined. The sequence may be predetermined, randomly selected or player selected as described in detail above. Assume a predetermined, random or player-selected sequence of differing nine-pin setups is selected with the following order: 1, 7, 10, 8, 6, 2, 9, 4, 3 and 5; these missing pins may be indicated in parenthesis alongside the number of the respective frame, as shown in the FIGURE. In other words, the number of the missing pin simply is inserted alongside the number of the respective frame having a conventional ten-pin setup with that respective pin missing.

Assume a twosome of "Jones" and "Smith" are playing the game. Each player is required to deliver at least one ball in each of the frames, such as two balls in a conventional bowling game. Jones delivers his first ball and scores a strike (knocking down all nine pins), whereupon that conventional designation is recorded on the score sheet, as shown. Smith delivers two balls in the first frame, knocking down seven pins on the first ball and two pins on the second ball, resulting in a spare, as shown.

On the next turn or frame where the "7" pin is missing, Jones knocks down eight pins on his first ball and the remaining pin on his second ball. Given credit for the missing pin, a ten-pin count is added to his score for the first frame, giving Jones a first frame score of "20". In other words, as in the scoring scheme of a conventional bowling game, the number of pins knocked down by a player on the next two balls following a strike are recorded with the pins of the previous frame, except the missing pin credit is added.

In the second frame, Smith also knocks down eight pins on his first ball, one pin on his second ball, resulting in a spare, as shown. However, again as with the scoring of a conventional bowling game, the number of pins knocked down by the respective player only on the next one ball is added to the score of the previous frame if a spare was recorded in that previous frame. Therefore, given credit for the missing pin on his first ball, Smith would receive a score of "19" for his first frame (i.e. ten pins for the first frame, eight pins knocked down with the first ball in the second frame, and the one pin credit).

In the third frame, it can be seen that the "10" pin is missing to present still another differing pin setup of nine pins. In the third frame, Jones knocks down four pins with his first ball and three pins with his second ball. The four pins, plus the one pin credit, are added to the previous frame score, resulting in a score of "15" which is added to the score of "20" of the first frame, and resulting in a running score for the second frame of "35". Since Jones did not score either a strike or a spare in the third frame, there is no carry-over for addition purposes, and a third frame score of eight pins is added to result in a running score of "43" through the third frame.

A similar occurrence happened to Smith in the third frame wherein Smith failed to score either a strike or a spare because he knocked down two pins with his first ball and six pins with his second ball. By adding the two pins plus the one pin credit to the ten pins of the second frame, a running score of "32" through two frames and "41" through three frames is achieved. This scoring scheme is carried on throughout all ten frames wherein differing pin setups of singular missing pins are presented to the players. The winner of the game is determined by comparing the final players' game scores. Of course, rather than having a running score throughout the game, individual frame scores can be recorded and the frame scores all being added and placed in the "Total" column to indicate the respective player's game scores.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of playing a bowling game in which players are allowed a preselected number of balls to knock down all pins in each of a plurality of frames, said method comprising:

(a) selecting a sequence of a plurality of differing pin setups of a constant number of pins for each frame, the constant number being less than ten;

(b) requiring each player to deliver at least one ball in each of said frames;

(c) counting the number of pins knocked down by each player in each frame, the player being given credit for the number of pins said constant number is less than ten with strikes recorded for all said constant number of pins knocked down by a first ball and spares recorded for all said constant number of pins knocked down by a second ball;

(d) adding to said counted number of pins the number of pins knocked down by the respective player on the next two balls if a strike was recorded in the previous frame, and the number of pins knocked down by the respective player on the next one ball if a spare was recorded in the previous frame, to determine a score for each player for each frame;

(e) recording each player's frame score;

(f) adding each player's frame scores to determine said player's total score for the game; and (g) comparing the players' game scores to determine the winner of the game.

2. The method of claim 1 wherein said sequence of a plurality of differing pin setups is predetermined.

3. The method of claim 2 wherein there are nine pins in each of said differing pin setups.

4. The method of claim 1 wherein said sequence of a plurality of differing pin setups is randomly selected.

5. The method of claim 4 wherein there are nine pins in each of said differing pin setups.

6. The method of claim 1 wherein at least one player is allowed to select the pin setup in at least one of the frames.

7. The method of claim 6 wherein a player is allowed to preselect a predetermined sequence of differing pin setups before game play starts.

8. The method of claim 7 wherein there are nine pins in each of said differing pin setups.

9. The method of claim 6 wherein a player is allowed to preselect a given pin setup for all frames of the game.

10. The method of claim 6 wherein all other players must play the pin setup selected by said one player.

11. The method of claim 6 wherein all of the players of the game must play the pin setup selected by said one player.

* * * * *

UNITED STATES PATENT AND TRADEMARK OFFICE

CERTIFICATE OF CORRECTION

PATENT NO. : 4,834,378

DATED : May 30, 1989

INVENTOR(S) : Ted E. Brim

It is certified that error appears in the above-identified patent and that said Letters Patent is hereby corrected as shown below:

In the Title: Please change title of this patent from "Method of Playing Of Bowling Game" to --Method of Playing A Bowling Game --.

Signed and Sealed this

Thirteenth Day of February, 1990

*Attest:*

JEFFREY M. SAMUELS

*Attesting Officer*

*Acting Commissioner of Patents and Trademarks*